United States Patent [19]

Stang et al.

[11] 4,343,268

[45] Aug. 10, 1982

[54] ENERGY CONSERVING EXHAUST PASSAGE FOR AN INTERNAL COMBUSTION ENGINE

[75] Inventors: John H. Stang; Walter A. Brighton; David A. Ruthmansdorfer, all of Columbus, Ind.

[73] Assignee: Cummins Engine Company, Inc., Columbus, Ind.

[21] Appl. No.: 46,222

[22] Filed: Jun. 7, 1979

[51] Int. Cl.[3] ..... F01L 1/26

[52] U.S. Cl. ..... 123/90.4; 123/90.22; 123/188 M; 123/315; 60/324

[58] Field of Search ..... 123/90.22, 90.4, 188 GC, 123/188 M, 193 H, 315, 188 R, 188 S, 188 VA; 60/324

[56] References Cited

U.S. PATENT DOCUMENTS

| | | | |
|---|---|---|---|
| 2,318,914 | 5/1943 | Anderson et al. | 123/90.22 |
| 3,208,440 | 9/1965 | Portmann | 123/90.4 |
| 3,438,198 | 4/1969 | Bentele | 60/30 |
| 3,590,597 | 7/1961 | Blank | 123/193 H |
| 3,613,647 | 10/1971 | Mettig et al. | 123/90.22 |
| 3,832,983 | 9/1974 | Nickly | 123/188 M |
| 3,861,376 | 1/1975 | Ashley | 123/188 M |
| 3,874,357 | 4/1975 | List et al. | 123/188 M |

FOREIGN PATENT DOCUMENTS

| | | | |
|---|---|---|---|
| 861173 | 12/1952 | Fed. Rep. of Germany | 123/315 |
| 1576267 | 3/1970 | Fed. Rep. of Germany | 123/315 |

*Primary Examiner*—Craig R. Feinberg
*Assistant Examiner*—W. R. Wolfe
*Attorney, Agent, or Firm*—Sixbey, Friedman & Leedom

[57] ABSTRACT

An exhaust passage 8 is provided for an internal combustion engine equipped with dual exhaust valves 18 and 19 for each cylinder 12 wherein the passage 8 directs the combination of the two streams formed by the exhaust valve ports 16 into a single stream in a manner to conserve the maximum available energy. Fluid flowing through exhaust ports 16 is directed by a guide vane 54 which has been cast in the exhaust passage 8 wherein vane 54 is formed to contain a keyhole shaped slot 57 to provide clearance for downstream valve stem 21 and to eliminate the disrupting effects which would otherwise result from an oversize clearance hole due to the leading edge effect. Keyhole shaped slot 57 permits unconstrained expansion and contraction of the exhaust passage in response to thermal cycling caused by normal engine operation thereby avoiding the effects of thermal fatigue.

13 Claims, 5 Drawing Figures

ENERGY CONSERVING EXHAUST PASSAGE FOR AN INTERNAL COMBUSTION ENGINE

DESCRIPTION

Technical Field

The present invention relates generally to internal combustion engines and, more specifically, to energy conserving exhaust ports for turbocharged diesel engines.

Background Art

It is desirable in achieving energy-efficient internal combustion engine operation that provisions be made in the design of the engine for the movement of the highest possible volume of fluid flow into and out of the combustion chambers with the minimum fluid flow energy loss. Other operational objections may, however, require some compromise of this goal. For example, it is sometimes necessary to accept less than optimum low-loss flow within the intake manifold in order to promote better mixing of the air-fuel mixture. No such requirement exists on the exhaust side where fluid flow out of the combustion chambers should normally be as smooth as possible to maintain the maximum energy in the exhaust fluid especially when the exhaust gases are used to drive an engine turbocharger. The dual exhaust ports generally used to provide maximum outflow capability aggravate the difficulty of achieving low-loss flow in the exhaust passages since such dual exhaust valves inherently form two separate fluid flow streams resulting in mixing losses when the streams are recombined. High loss flow is further aggravated by the stems of the conventional exhaust valves one of which is normally positioned within the combined downstream flow path of the exhaust gases.

In an attempt to obtain more efficient exhaust fluid transfer in engines equipped with dual exhaust valves it has been proposed to place guide vanes in the exhaust passages to promote smoother flow. For example, U.S. Pat. No. 3,590,797 to Blank depicts a cylinder head with a pair of exhaust ports separated by a flow divider which terminates short of the upstream edge of the second exhaust valve guide and stem. A structure of this configuration does not extend far enough downstream of the exhaust valves to maintain initial fluid volume and pressure or to promote the smooth flow essential to the prevention of energy loss. If the flow divider were extended further downstream, increased opportunity for thermal fatigue, possibly resulting in a structural failure would occur. In addition, machining such a flow divider to provide for passage of the second exhaust valve guide and stem through the extended flow divider is difficult and costly. Provision of an extended flow divider would further complicate the process of casting the engine head by requiring the use of two mold cores separated by the total length of the divider.

U.S. Pat. No. 3,438,198 to Bentele discloses an exhaust manifold in which two fluid flow streams are joined to form a single fluid flow stream. The fluid flow guiding structure disclosed therein is not designed to promote smooth flow since the structure is depicted in combination with a plurality of devices attached to it and to the exhaust manifold to promote turbulence in the fluid flow in order to assure complete combustion of exhaust materials. However, even if the flow guiding structure were disclosed without the turbulence promoting devices, it does not extend sufficiently downstream of the two exhaust ports to provide the desired substantially smooth, energy conserving flow.

It is well known, as evidenced by the prior art, to split fluid flow into the cylinder from a single stream into two or more streams. For example, U.S. Pat. Nos. 2,318,914 to Anderson; 3,861,376 to Ashley and 3,874,357 to List et al. all disclose fluid flow splitting structures directed primarily toward producing turbulence in the fluid entering the cylinder to achieve a more effective, uniform air-fuel mixture. However, none of these references is concerned specifically with regulating conditions of fluid flow to achieve a smooth, energy conserving flow in cylinder exhaust ports for outlet ducts.

Disclosure of Invention

It is the purpose of this invention to provide a structure for directing the flow of exhaust gases in an internal combustion engine which overcomes the drawbacks of the prior art as discussed above.

A specific object of the present invention is to provide structure which promotes efficient fluid flow from the cylinder exhaust ports of an internal combustion engine, thus conserving the maximum energy possible in the exhaust fluid.

Yet another object of the present invention is to provide an easily formed, low cost structure which receives two fluid flow streams from dual cylinder exhaust ports and forms two substantially smooth fluid flow streams by guiding them toward parallel paths to a point substantially downstream of the exhaust valves where they combine to form a single fluid flow stream out of the cylinder.

Still another object of this invention is to provide a fluid flow guiding structure which extends substantially downstream of the downstream exhaust valve in a dual exhaust valve arrangement which fluid flow guiding structure provides sufficient clearance between the second exhaust valve stem and the guiding structure without requiring specialized machining while at the same time avoids the losses due to the leading edge effect.

A further object of this invention is to provide a low-loss fluid flow guide for a dual exhaust valve internal combustion engine wherein the guide is effective without materially complicating the processes of casting or machining the engine port forming the guide.

In accordance with the present invention an exhaust passageway is provided for an internal combustion engine which passage extends downstream from a pair of cylinder exhaust ports separated by a fluid flow guide vane which extend a substantial distance downstream of the second exhaust valve. The guide vane contains a central slot commencing adjacent the stem of the second exhaust valve stem to provide substantial clearance therefrom and extending downstream over the remaining portion of the guide vane. The novel structure of the guide vane of the present invention promotes the maintenance of initial flow volume and pressure of the exhaust gases as well as the smooth flow essential to low energy loss. Moreover, forming the guide vane with a central slot shaped to accomodate the downstream exhaust valve facilitates casting of the structure and results in an exhaust passage design which is less subject to thermal fatigue and is thus more reliable than was heretofore available. The guide vane or flow divider required by prior art structures and the flow losses resulting from the leading edge effect of a hole machined large enough for the valve stem are eliminated by the structure of the present invention.

BRIEF DESCRIPTION OF THE DRAWINGS

The details of the present invention will be described in connection with the accompanying drawings, in which.

BEST MODE FOR CARRYING OUT THE INVENTION

Figure 1:
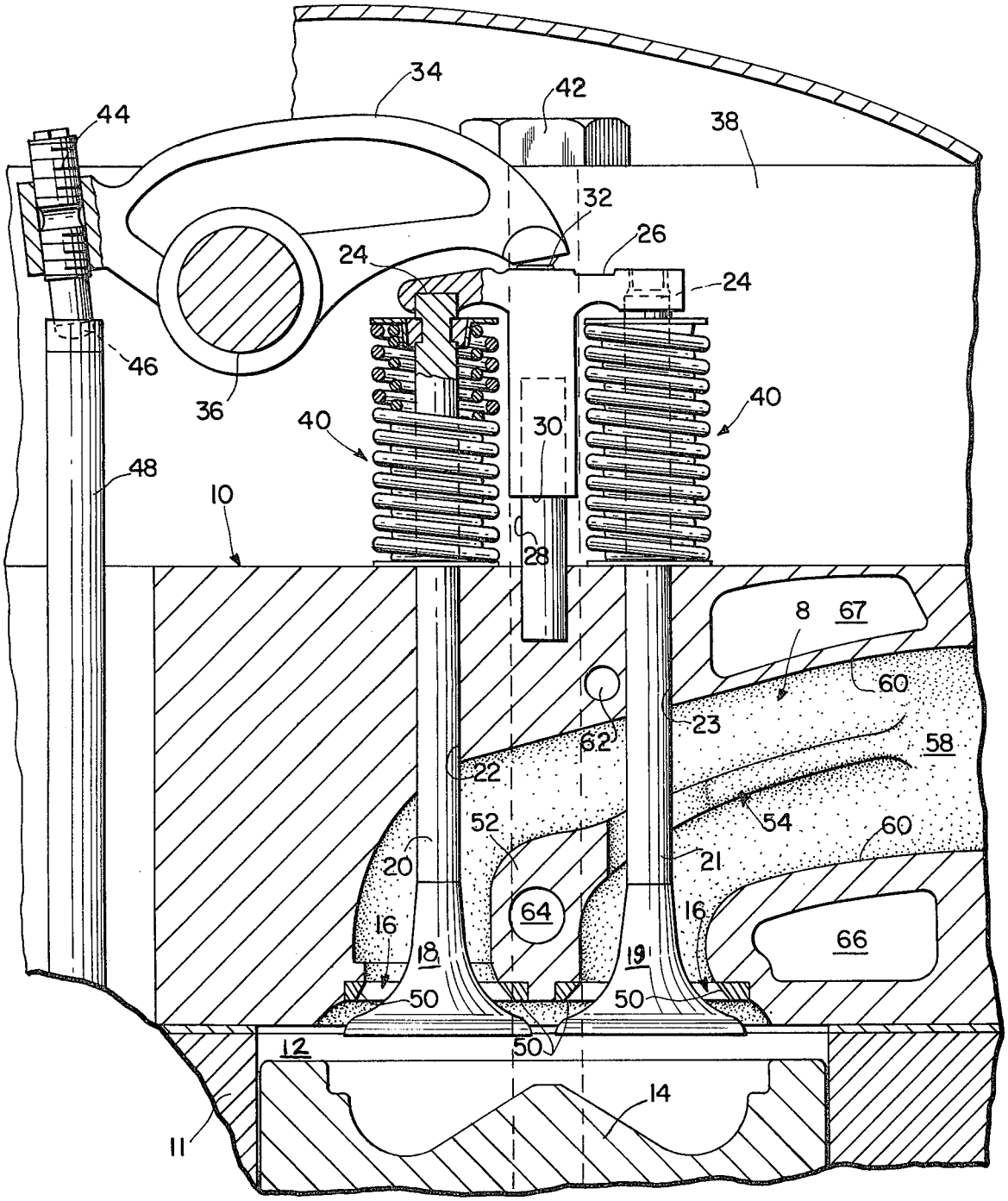
FIG. 1 is a fragmentary cross sectional view of the head portion of an internal combustion engine particularly illustrating an exhaust passage designed in accordance with the present invention.

Referring to the drawings, the exhaust passage 8 of the present invention is illustrated in FIG. 1. To permit a better understanding of this invention, those portions of the internal combustion engine illustrated in FIG. 1 will be briefly described. In particular, FIG. 1 depicts an internal combustion engine head 10 in which exhaust passage 8 is formed. Head 10 connects with an engine block 11 containing a cylinder 12 in which a piston 14 is positioned for reciprocating movement. Head 10 is secured to the engine block 11 by suitable bolts (not shown). Exhaust gases are expelled from cylinder 12 through exhaust ports 16 into the exhaust gas passage 8 the overall shape of which is designed to redirect the pair of vertically oriented gas streams formed by ports 16 into a single gas stream which moves generally laterally toward the engine exhaust manifold (not illustrated). Opening and closing of exhaust poppet valves 18 and 19 is effected by means of valve stems 20 and 21 extending through exhaust gas passage 8 with valve stem 21 being downstream of stem 20.

Stems 20 and 21, respectively, extend through bores 22 and 23 in head 10. The upper ends 24 of each valve stem is received in a recess of a T-shaped cross head assembly 26. Cross head assembly 26 guided by a guide pin 28 fixed in head 10 and telescoped into a bore 30 in cross head assembly 26.

Cross head assembly 26 has an abutment surface 32 acted on by one end of a rocker arm 34 which is pivotally mounted on a shaft 36 supported in walls 38 surrounding cross head assembly 26 and the upper ends of valves 18. Each valve 18 and 19 is biased toward a closed position by spring assembly 40. Walls 38 are secured to head 10 by capscrews 42 to form a rocker housing. A threaded pin 44 on the opposite end of rocker arm 34 is received in a cup shaped recess 46 of a push rod 48. Push rod 48 is reciprocated by a cam (not shown) to open valves 18 and 19 at the correct time and for the proper interval. When closed, valves 18 and 19 engage valve seats 50. Passages 62, 64, 66 and 67 are provided in head 10 to direct engine coolant throughout for cooling purposes.

When valves 18 and 19 are open, exhaust gas from the cylinder 12 flows through exhaust ports 16 separated by a valve bridge 52 thereby forming two separate exhaust gas streams oriented generally upwardly. While valve seats 50 are contoured to impart a smooth flow to the exhaust gases, it is necessary to redirect the exhaust gases laterally for connection with the exhaust manifold (not illustrated). The shape of exhaust passage 8 is effective to accomplish this end but at the expense of creating a significant amount of energy consuming turbulence. In order to avoid this problem a guide means or vane 54 designed in accordance with this invention is formed in passage 8 integral with the inside walls of passage 8 and valve bridge 52. The shape of guide vane 54 will be described in greater detail hereinbelow. It is the purpose of guide vane 54 to redirect separately the two exhaust gas streams formed by exhaust ports 16 in two substantially parallel paths until they reach a flow combining area 58 located a substantial distance downstream from valve stem 21 where the two streams join to become one fluid stream, which then flows out of head 10.

Figure 2:
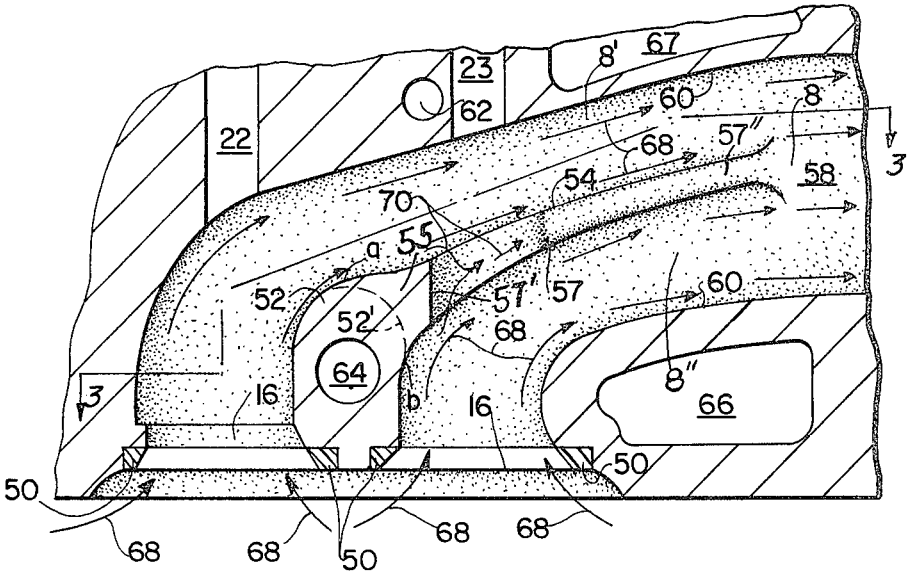
FIG. 2 is an enlargement of the same view shown in FIG. 1, omitting the exhaust valves and valve train.

FIG. 2 illustrates an enlarged view of the exhaust passage 8 of the present invention omitting the details of the engine head and exhaust valve. Arrows 68 represent the flow of exhaust gas out of the cylinder and through exhaust ports 16. The outside boundary of the fluid stream generally follows the flow path defined by outer walls 60 of passage 8. Valve bridge 52 joins with a portion of the inside walls of exhaust ports 16 and thus initially splits the exhaust gases into two separate streams. As clearly illustrated in FIG. 2, the upstream end 55 of guide vane 54 is integral with bridge 52. Dashed lines 52′ are included to show the boundary contour of bridge 52 at the point of connection with guide vane 54 of this invention. FIG. 2, thus, clearly shows that the exterior walls of the upstream end 55 of guide vane 54 are shaped to blend smoothly at points a and b into the exterior walls of valve bridge 52. By avoiding discontinuities in the walls of passage 8, the flow of exhaust gases therein is maintained as smooth and energy efficient as possible. Guide vane 54 extends downstream from bridge 52 for a substantial distance beyond valve stem 21 (not illustrated in FIG. 1) and is positioned and shaped to substantially bi-sect the cross sectional flow path of passage 8 into two separate passages 8′ and 8″ (which may be termed subpassages) wherein the cross sectional area of passages 8′ and 8″ is substantially equal. The two gas streams formed by ports 16 are maintained substantially separate for a substantial distance downstream of valve stems 20 and 21 before the streams are allowed to join in area 58. For reasons which will be more fully explained hereinbelow, guide vane 54 contains a centrally located slot 57 connecting passages 8′ and 8″ and extending from a point 57′ upstream of valve stem 21 to a point 57″ located a significant distance downstream within passage 8. The distance between points 57′ and 57″ is approximately equal to the distance between the central axes of valve stems 20 and 21 although some variation in this distance may be tolerated.

Slot 57 allows a small portion of the exhaust gases in passages 8′ and 8″ to combine as shown by arrows 70, but most of the fluid, as represented by arrows 68, remains in two distinct fluid streams until the streams reach area 58. Because slot 57 extends all of the way to the downstream end of guide vane 54, the samll amount of exhaust gas from passages 8′ and 8″ mixed within slot 57 is moved toward the exhaust gas joining area 58 along a path substantially parallel to the path of gas flow within passages 8′ and 8″. Thus, the presence of guide vanes 54 prevents any substantial intersection of the two fluid flow streams from ports 16 before the streams are allowed to join. In addition, guide vane 54 allows the maintenance of a fluid velocity and pressure approximating that which is developed as the exhaust gases first enter passage 8.

Figure 3:
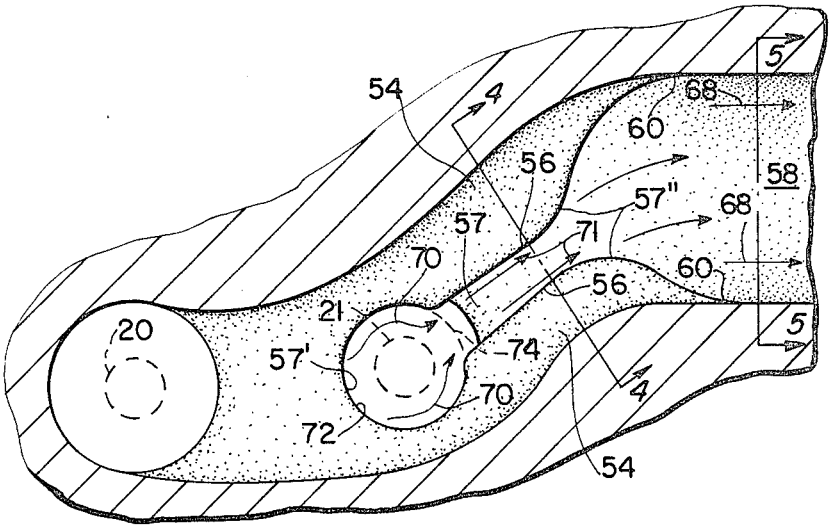
FIG. 3 is a cross sectional view of the exhaust passage of the present invention taken along the lines 3—3 of FIG. 2.

FIG. 3 depicts a cross section of the exhaust port of the present invention taken along the line 3—3 of FIG. 2 and is pictured as it would appear when viewed from above cylinder head 10. As will be explained below, sufficient clearance must be provided to accomodate valve stem 21 of the downstream exhaust valve. This is achieved by forming slot 57 in a keyhole configuration as shown in FIG. 3. Typically, exhaust valve stem 21 will be about ⅜ inch in diameter and edge 72 of guide vane 54, defining the enlarged portion of the keyhole slot 57 around valve stem 21, will be arcuate in shape with a radius of curvature of about 0.93 cm or ⅜ inch to provide the clearance desired as will be explained below. The remaining portion of keyhole slot 57 extending downstream of valve stem 21 is formed by guide vane edges 56 where are generally parallel and separated by a distance of about 0.63 cm to 0.93 cm or ¼ to ⅜ inch and extend from arcuate edge 72 a substantial distance downstream of valve stem 21 relative to the lateral spacing of the stems 20 and 21. Some of the exhaust fluid flowing through ports 16 will tend to collide with valve stem 21 in the area bounded by arcuate edge 72, but will then be directed downstream to area 58 of the exhaust passage by guide vane 54 along a path substantially parallel to that followed by the rest of the fluid flowing through ports 16, thus minimizing flow disruption and mixing losses which would occur if no fluid guiding means were provided. Arrows 71 represent the flow of such fluid.

To understand the need for slot 57, it should be noted that if guide vane 54 were cast as a single integral solid structure, a hole would have to be machined in the vane to allow valve stem 21 to pass therethrough. To avoid such machining costs a hole substantially larger than the valve stem could be cast in the head but would present difficulties associated with the leading edge effect. This disadvantage can be understood by considering FIGS. 2 and 3, simultaneously. If keyhole slot 57 were replaced by a circular clearance hole around valve stem 21, the exhaust gases from passages 8' and 8'' which combine together in this clearance hole (note arrows 70) would have to be split apart again by the downstream edge of the clearance hole as represented by dashed lines 74 in FIG. 3. Thus, the present design eliminates the cost of machining a hole in guide vane 54 and at the same time eliminates the disruptive effect of an additional leading edge in the flow path as would result if a sufficiently larger circular hole were cast in the guide vane to eliminate the need for machining.

Typically slot 57 will have a total length in the direction of fluid flow of between 3 cm and 7 cm. The radius of curvature of edge 72 may vary from 0.5 cm to 1.5 cm. The total length of guide vane 54 will typically vary from 3 cm to 9 cm depending on the size of the exhaust valves, passage 8 and the engine displacement.

The structure of guide vane 54 possesses the additional advantage of being easier to manufacture than a solid flow divider structure. A solid flow divider must be first cast and then drilled to provide a suitable size hole to accomodate the exhaust valve stem. Guide vane 54 and keyhole shaped slot 57 of the present invention may be cast in a single operation. When forming the mold for casting head 10, the portion of the mold which forms slot 57 will create a bridge between the portions of the mold which form passages 8' and 8''. This bridging portion of the mold will measurably add to the strength of the mold and thus improve the dimensional accuracy of the casting process.

Figure 4:
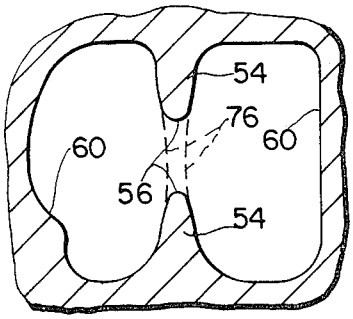
FIG. 4 is a cross sectional view taken along the lines 4—4 of FIG. 3.

FIG. 4 is a cross section taken along line 4—4 of FIG. 3 showing the spatial relationship between guide vane 54 and exhaust port passage walls 60. As shown in FIGS. 1 and 2, coolant passageways 62, 64, 66 and 67 surround the exhaust ports of the present invention. The coolant in these passageways functions to maintain the area outside walls 60 at a lower temperature than that of the hot exhaust gases flowing in the vicinity of guide vane 54. The heat from the exhaust stream will thus cause expansion of guide vane 54. Slot 57, thus, permits edges 56 to move toward and away from one another without constraint. Likewise, unconstrained contraction of the portion of guide vane 54 separated by slot 57 is possible when the temperature drops. In exhaust ports utilizing a solid flow divider, there would be no separation area, but a solid piece, as depicted by dashed lines 76, would completely separate the two exhaust passages 8' and 8''. This structure would be subject to the same extreme temperature variations already described; however, a solid flow divider of this design is not free to expand and contract without constraint. Hence, this type of flow splitter is highly subject to thermal fatigue and, ultimately, structural failure, both of which are avoided in the design of the present invention. The edge portions (56 and 72) of vane 54 which defines slot 57 can, thus, be considered to be a thermal fatigue preventing means.

Figure 5:
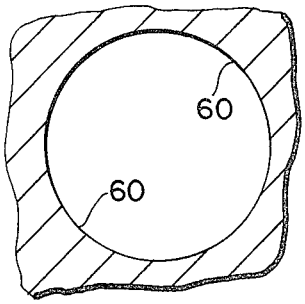
FIG. 5 is a cross sectional view taken along lines 5—5 of FIG. 3.

FIG. 5 is included to illustrate that the shape of the exhaust passage smoothes out downstream of guide vane 54 and becomes rounded to provide better channeling of the flow into the exhaust manifold, further providing for minimal energy loss from the exhaust gas. In its broader aspects, the subject vane design could be used in any portion of an exhaust passage within an internal combustion engine where two parallel fluid steams need to be joined together and redirected to flow in a direction different from the initial direction of the two fluid steams.

Industrial Applicability

The flow directing exhaust passage of the present invention will find its primary application in diesel or other internal combustion engines in which it is desired to maintain and preserve the maximum available energy in the exhaust gas. Such is particularly the case where the exhaust gases are used to power a turbocharger. The guide vane design described herein controls the flow of exhaust gas from the cylinder so that the energy present when the gas enters the exhaust ports is conserved to the maximum extent possible as the gas flows out of the exhaust passage. This is achieved by providing structure that maintains a smooth fluid flow with minimal disruption and mixing loss so that, for example, the exhaust gas entering the turbocharger of a diesel engine will provide sufficient energy to allow the turbocharger to function at improved efficiency.

While the present invention has been described with reference to specific embodiments thereof, it will be understood that numerous modifications may be made by those skilled in the art wthout actually departing from the scope of the claimed invention. Accordingly, all modifications and equivalents may be resorted to which fall within the scope of the invention as claimed.

We claim:

1. Exhaust passage apparatus for directing the flow of exhaust fluid within an internal combustion engine including first and second exhaust poppet valves having separate valve stems which may be simultaneously operated to open corresponding first and second exhaust valve ports shaped to form a pair of exhaust gas streams moving generally parallel to one another in a first direction, said exhaust passage apparatus comprising (a) exhaust passage forming means for receiving and joining the pair of exhaust gas streams formed by the exhaust ports and for redirecting the joined gas steams along a path which has a second direction different from the first direction and which intersects the stem of the second poppet valve at a point downstream from the first poppet valve to cause the exhaust gas stream formed by the first exhaust valve port to contact directly the stem of the second poppet valve, said exhaust passage forming means containing an exhaust passage extending from the exhaust valve ports to a joining area substantially downstream of the stem of the second poppet valve; and (b) guide means positioned within said exhaust passage and integral with said exhaust passage forming means for redirecting the pair of exhaust gas streams toward the second direction and for maintaining the pair of exhaust gas streams substantially separate until the pair of exhaust gas streams are both moving parallel to one another in the second direction prior to reaching said joining area defined by said exhaust passage forming means, said guide means including a vane positioned within said exhaust passage for dividing the exhaust passage into a pair of sub exhaust passages for receiving, respectively, the pair of exhaust gas streams formed by the exhaust valve ports, said vane extending from a point adjacent the exhaust valve ports to a point just upstream from said joining area and containing an opening shaped to provide an open clearance space between the stem of the second exhaust valve and said vane, said space communicating with both said pair of sub exhaust passages, wherein said exhaust passage forming means includes an exhaust valve bridge positioned between the exhaust valve ports and shaped to define a portion of the exhaust valve ports and wherein the upstream end of said vane is connected integrally with said exhaust valve bridge, the exterior surfaces of said vane being shaped to blend smoothly with the exterior surfaces of said exhaust valve bridge, whereby the juncture point of said vane and said exhaust valve bridge is free of surface discontinuities, and said vane has a total length in the direction of fluid flow of between 3 cm and 9 cm.

2. Exhaust passage apparatus for directing the flow of exhaust fluid within an internal combustion engine including first and second exhaust poppet valves having separate valve stems which may be simultaneously operated to open corresponding first and second exhaust valve ports shaped to form a pair of exhaust gas streams moving generally parallel to one another in a first direction, said exhaust passage apparatus comprising (a) exhaust passage forming means for receiving and joining the pair of exhaust gas streams formed by the exhaust ports and for redirecting the joined gas streams along a path which has a second direction different from the first direction and which intersects the stem of the second poppet valve at a point downstream from the first poppet valve to cause the exhaust gas stream formed by the first exhaust valve port to contact directly the stem of the second poppet valve, said exhaust passage forming means containing an exhaust passage extending from the exhaust valve ports to a joining area substantially downstream of the stem of the second poppet valve and said exhaust passage forming means includes an exhaust valve bridge positioned between the exhaust valve ports and shaped to define a portion of the exhaust valve ports; and (b) guide means positioned within said exhaust passage and integral with said exhaust passage forming means for redirecting the pair of exhaust gas streams toward the second direction and for maintaining the pair of exhaust gas streams substantially separate until the pair of exhaust gas streams are both moving parallel to one another in the second direction prior to reaching said joining area defined by said exhaust passage forming means, said guide means including a vane positioned within said exhaust passage for dividing the exhaust passage into a pair of substantially parallel sub exhaust passages for receiving, respectively, the pair of exhaust gas streams formed by the exhaust valve ports, said vane extending from a point adjacent to the exhaust valve ports to a point just upstream from said joining area and containing an opening shaped to provide an open clearance space between the stem of the second exhaust valve and said vane, said space communicating with said pair of sub exhaust passages, wherein the upstream end of said vane is connected smoothly and integrally with said exhaust valve bridge so that the juncture of said vane and said exhaust valve bridge is free of surface discontinuities, the exterior surfaces of said vane being shaped to blend smoothly with the exterior surfaces of said exhaust valve bridge.

3. Apparatus as defined in claim 2, wherein said sub exhaust passages have substantially equal cross sectional areas along substantially the entire length thereof.

4. Exhaust passage apparatus for directing the flow of exhaust fluid within an internal combustion engine including first and second ports shaped to form a pair of exhaust gas steams moving generally parallel to one another in a first direction and spaced laterally from one another by a predetermined distance, said exhaust passage apparatus comprising (a) exhaust passage forming means for receiving and joining the pair of exhaust gas streams formed by the ports and for redirecting the joined gas streams along a path which has a second direction different from the first direction, said exhaust passage forming means containing an exhaust passage extending from the ports to a joining area substantially downstream of the stem of the second ports relative to the lateral distance between the pair of exhaust gas streams; and (b) guide means positioned within said exhaust passage and integral with said exhaust passage forming means for redirecting the pair of exhaust gas streams toward the second direction and for maintaining the pair of exhaust gas streams substantially separate until the pair of exhaust gas streams are both moving parallel to one another in the second direction prior to reaching said joining area defined by said exhaust passage forming means, said guide means including a vane positioned within said exhaust passage for dividing the exhaust passage into a pair of sub exhaust passages for receiving, respectively, the pair of exhaust gas streams formed by the ports, said vane extending from a point adjacent the ports to a point just upstream from said joining area, said vane including thermal fatigue preventing means for preventing material fatigue due to temperature changes in the exhaust gases flowing through said sub exhaust gas passages, said thermal fatigue preventing means including a portion of said vane defining a central slot dimensioned to provide communication between said sub exhaust passages, said central slot extending from a point adjacent the second port to the joining area, whereby exhaust gases from the exhaust gas stream which are joined within said central slot may be moved into the joining area without being returned to said sub exhaust passages.

5. Apparatus as defined in claim 4, wherein said central slot has a total length in the direction of fluid flow between 3 cm and 7 cm.

6. Apparatus as defined in claim 4, wherein said vane is positioned to form sub exhaust passages having substantially equal cross sectional areas.

7. Apparatus as defined in claim 4, wherein said vane has a total length in the direction of fluid flow of between 3 cm and 9 cm.

8. Exhaust passage apparatus for directing the flow of exhaust fluid within an internal combustion engine including first and second exhaust poppet valves having separate valve stems which may be simultaneously operated to open corresponding first and second exhaust valve ports shaped to form a pair of exhaust gas streams moving generally parallel to one another in a first direction, said exhaust passage apparatus comprising (a) exhaust passage forming means for receiving and joining the pair of exhaust gas streams formed by the exhaust ports and for redirecting the joined gas streams along a path which has a second direction different from the first direction and which intersects the stem of the second poppet valve at a point downstream from the first poppet valve, said exhaust passage forming means containing an exhaust passage extending from the exhaust valve ports to a joining area substantially downstream of the stem of the second poppet valve; and (b) guide means positioned within said exhaust passage and integral with said exhaust passage forming means for redirecting the pair of exhaust gas streams toward the second direction and for maintaining the pair of exhaust gas streams substantially separate until the pair of exhaust gas streams are both moving parallel to one another in the second direction prior to reaching said joining area defined by said exhaust passage forming means, said guide means including a vane positioned within said exhaust passage for dividing the exhaust passage into a pair of sub exhaust passages for receiving, respectively, the pair of exhaust gas streams formed by the exhaust valve ports, said vane extending from a point adjacent the exhaust valve ports to a point just upstream from said joining area, and said vane contains a central slot dimensioned to provide substantial clearance around the stem of the second poppet valve and to provide limited communication between said sub exhaust passages, said central slot extending from a point upstream of the stem of the second poppet valve to the joining area, whereby exhaust gases from the exhaust gas stream which are joined within said central slot may be moved into the joining area without being returned to said sub exhaust passages.

9. Apparatus as defined in claim 8, wherein said central slot has a keyhole shape with the enlarged end positioned to surround the stem of the second poppet valve and the remaining portion of the keyhole extending from the enlarged end to the joining area.

10. Apparatus as defined in claim 9, wherein said remaining portion of said central slot is formed by a pair of opposed parallel edges of said vane.

11. Apparatus as defined in claim 9, wherein said enlarged end of said central slot is formed by an edge of said vane which has a radius of curvature equal to approximately twice the width of said remaining portion of said central slot.

12. Apparatus as defined in claim 11, wherein said central slot has a total length in the direction of fluid flow between 3 cm and 7 cm.

13. Apparatus as defined in claim 12, wherein the radius of curvature of said enlarged end is between 0.5 cm and 1.5 cm.

* * * * *